US005451036A

United States Patent [19]

Eastwood

[11] Patent Number: 5,451,036

[45] Date of Patent: Sep. 19, 1995

[54] METALLURGICAL DART AND METHOD OF ASSEMBLY

[75] Inventor: Owen Eastwood, Sprotborough, Great Britain

[73] Assignee: Monocon International Limited, South Yorkshire, Great Britain

[21] Appl. No.: 211,186

[22] PCT Filed: Sep. 24, 1992

[86] PCT No.: PCT/GB92/01757

§ 371 Date: Mar. 23, 1994

§ 102(e) Date: Mar. 23, 1994

[87] PCT Pub. No.: WO93/06957

PCT Pub. Date: Apr. 15, 1993

[30] Foreign Application Priority Data

Sep. 28, 1991 [GB] United Kingdom ..... 9120602

[51] Int. Cl.[6] ..... C21C 5/46

[52] U.S. Cl. ..... 266/272; 222/597; 29/508; 29/515; 29/516

[58] Field of Search ..... 266/45, 272, 230; 222/597; 29/508, 515, 516

[56] References Cited

U.S. PATENT DOCUMENTS 4,399,986 8/1983 Collins .
4,709,903 12/1987 LaBate ..... 266/45

FOREIGN PATENT DOCUMENTS 1515629 6/1978 United Kingdom .
2236837 4/1987 United Kingdom ..... 266/272
2188132 9/1987 United Kingdom .
2190475 11/1987 United Kingdom .
2210150 6/1989 United Kingdom .

*Primary Examiner*—Melvyn Andrews
*Attorney, Agent, or Firm*—Trexler, Bushnell, Giangiorgi & Blackstone

[57] ABSTRACT

A metallurgical dart includes an enlarged refractory head having a top, a bottom, and a central through hole extending from top to bottom of the head and lined with a metallic sleeve, with a portion of the lining sleeve projecting beyond the top and/or bottom of the head; an elongate tail of refractory material with an external and/or internal metallic element and of external diameter slightly less than the internal diameter of the lining sleeve, such that the tail can pass, as a close fit, through the lining sleeve of the head; and at least one crimped or other joint between the metallic element of the tail and the projecting portion of the lining sleeve, to fix the head and tail together.

13 Claims, 3 Drawing Sheets

METALLURGICAL DART AND METHOD OF ASSEMBLY

This invention relates to a so-called dart, as used in the metallurgical industry in the tapping of furnaces to control, or preclude, slag exit and hence slag contamination of the steel etc. being cast.

Conventional darts consist basically of a head and an attached tail, the head being an enlarged body of refractory material and the tail being a relatively slender, elongate member, e.g. of 1 m length, with at least a portion of the tail extending below the head and being adapted to engage in the tap hole of the furnace, the head acting in effect as a float valve member and eventually closing off the tap hole as the level of the melt falls, to prevent slag exiting via the tap hole.

Conventionally, the head and tail of a dart are supplied as two separate components and are either assembled on site, or alternatively are assembled elsewhere and delivered as a single, assembled unit, although the latter arrangement creates problems with regard to packaging and transport.

In one known construction, the tail consists of a refractory concrete sleeve surrounding, and keyed to, a central reinforcing bar, the latter protruding from the upper end of the sleeve for engagement by a gripper of a lifting and lowering mechanism, and having—towards what in use is its upper end—a shoulder on which the body is adapted to be seated and there secured by air setting cement. Care must be taken to ensure that no excessive cement is used, and furthermore, a hardwood wedge must firstly be cut and then hammered into a gap at the side of the reinforcing bar, but not to an extent that would over-stress the body and result in cracking.

In another known construction, the protruding upward end of the reinforcing bar is screw threaded, being passed through, and projecting beyond, a central hole of the head, with the latter seating on the upper end of the dart, and with the head being secured in position on the tail by a nut applied to the threaded projection.

Clearly, the above operations require a relatively skilled operator, is time consuming, and despite the care being taken in assembly, sometimes results in a damaged dart and hence the production of a scrap dart as the tail is relatively fragile, despite the presence of the reinforcing bar.

The basic object of the invention is to provide an improved dart, and an improved method of dart assembly, compared with prior art proposals.

According to a first aspect of the present invention, there is provided a metallurgical dart comprising:

(i) an enlarged refractory head having a top, a bottom, and a central through hole extending from top to bottom of the head and lined with a metallic sleeve, with a portion of the lining sleeve projecting beyond the top and/or bottom of the head;

(ii) an elongate tail of refractory material with an external and/or internal metallic element and of external diameter slightly less than the internal diameter of the lining sleeve, such that the tail can pass, as a close fit, through the lining sleeve of the head; and (iii) at least one crimped or other joint between the, or a, metallic element of the tail and the projecting portion of the lining sleeve, to fix the head and tail together.

According to a second aspect of the invention of independent significance, there is provided a method of assembling a two-part metallurgical dart comprising an enlarged head having a metallic element, and an elongate tail also having a metallic element, wherein two metallic elements are brought into close proximity and a crimped or other deformed metal joint is formed between them.

Preferably, the head also has a through hole, wherein the tail is inserted through the hole of the head, or alternatively the head is passed along the tail, and thereafter the crimped or other deformed metal fixing joint is made between the two metallic elements.

The invention also includes a metallurgical dart assembled by these methods.

Thus, with the dart in accordance with the invention, a substantially simplified assembly operation is possible, resulting not only in more rapid assembly but in minimized risk of failures, with attendant cost savings. Furthermore, as the tail, or at least a portion of the tail, passes completely through the head, the latter may be fixed at a selected location along the tail most appropriate for any particular application. Finally, the tail, if wholly or partially encased in a metallic sleeve or jacket, has considerably more strength than prior art tails, as the metallic sleeve or jacket protects the refractory during any mis-handling.

Whilst various forms of fixing joint between the metallic sleeves are possible—such as by welding or knock-in wedges—a crimped or other metal deforming joint is preferred.

Preferably, the external metallic element of the tail is an outer metallic sleeve casing the refractory material, while the refractory material of the tail may be partially or wholly encased by the sleeve.

The internal metallic element of the tail may be a central reinforcing bar embedded within the refractory material of the tail and projecting from what, in use, is an upper end of the tail. Preferably, the refractory material is monolithic, although the refractory material may be assembled from a plurality of pre-formed refractory sleeves fitted onto the central reinforcing bar or sleeve.

The projecting portion of the lining sleeve may be slightly beyond a top of the head, or slightly beyond the bottom of the head, or both above and below by the lining sleeve having a first projection portion beyond the top of the head, and a second projecting portion below the bottom of the head, so that the crimped or other joint is formed in the projecting portion of the lining sleeve beyond the top of the head, or in the projecting portion of the lining sleeve below the bottom of the head, or wherein a first crimped or other joint is formed in the projecting portion of the lining sleeve beyond the top of the head, while a second crimped or other joint is formed in the projecting portion of the lining sleeve below the bottom of the head.

The lining sleeve may be provided with a radially extending washer or flange at Its lower end engaging the head and thus serving as a supporting shelf for the head. The washer or flange may be located at the lower terminal end of the lining sleeve, or may be spaced from that end. Irrespective of its location the washer or flange is preferably secured by welding to the lining sleeve.

In another embodiment, the reinforcing bar may project from the upper end of the tail, and the crimped or other joint is formed between this projecting portion of the reinforcing bar and the portion of the lining sleeve. Preferably, the reinforcing bar projects beyond the crimped or other joint for engagement by a gripper for lifting and lowering the dart.

In one construction, both the refractory material of the tail and its external and/or internal metallic element pass through the hole of the head, while in another embodiment, the metallic element only of the tail passes through the hole of the head, which metallic element is conveniently the reinforcing bar. In this construction a terminal upper end of the refractory material of the tail may form an engaging shoulder to abut, directly or indirectly, the bottom of the head. Alternatively, a socket may be formed in the bottom of the head, a washer of the lining sleeve may be located at the inner end of the socket, and a terminal, upper end of the refractory material of the tail may form an engaging shoulder to abut an underside of the washer.

Furthermore, the lining sleeve may be provided external with a plurality of refractory anchorages e.g. "V"-shaped elements, to assist in keying the refractory material of the head to its lining sleeve, while the lining sleeve and the metallic element(s) of the tail or preferably formed of mild steel.

Examples of dart in accordance with the first aspect of the invention, and assembled in accordance with the second aspect of the invention, will now be described in greater detail with reference to the accompanying drawings, in which.

Figure 2:
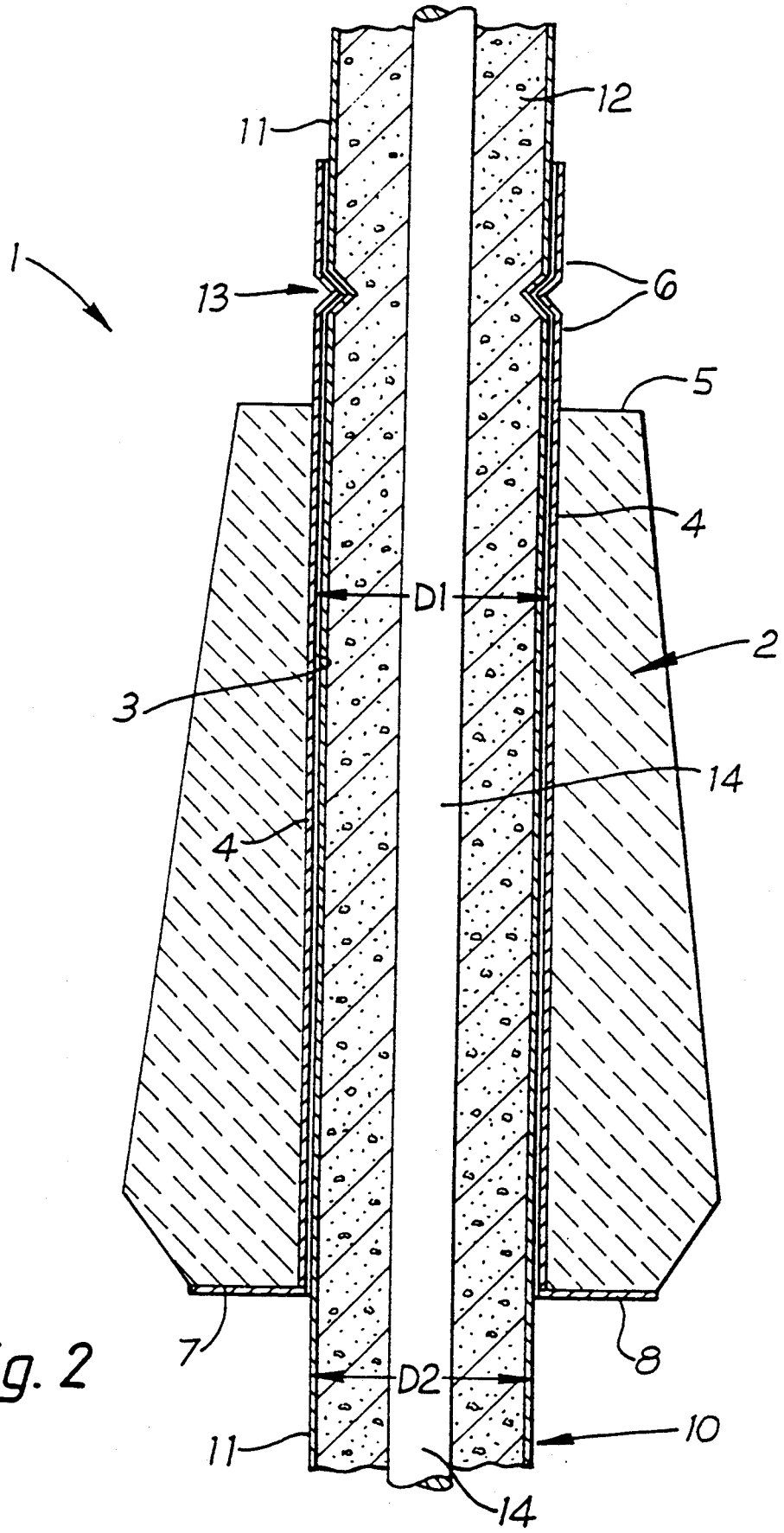
FIG. 2 is also a longitudinal sectional view, but to a larger scale compared with FIG. 1, of a second embodiment of dart.
Figure 3:
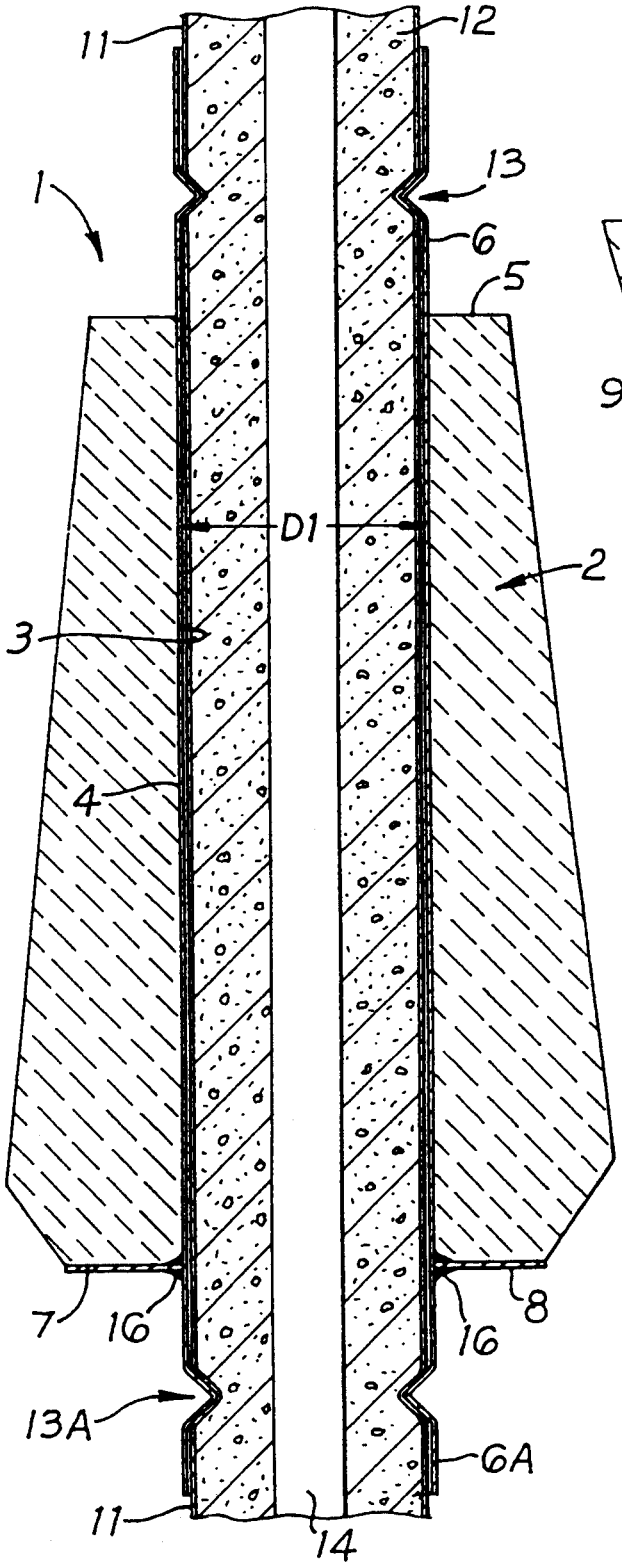

FIG. 3 corresponds to FIG. 2 but shows a third embodiment; and

Figure 1:
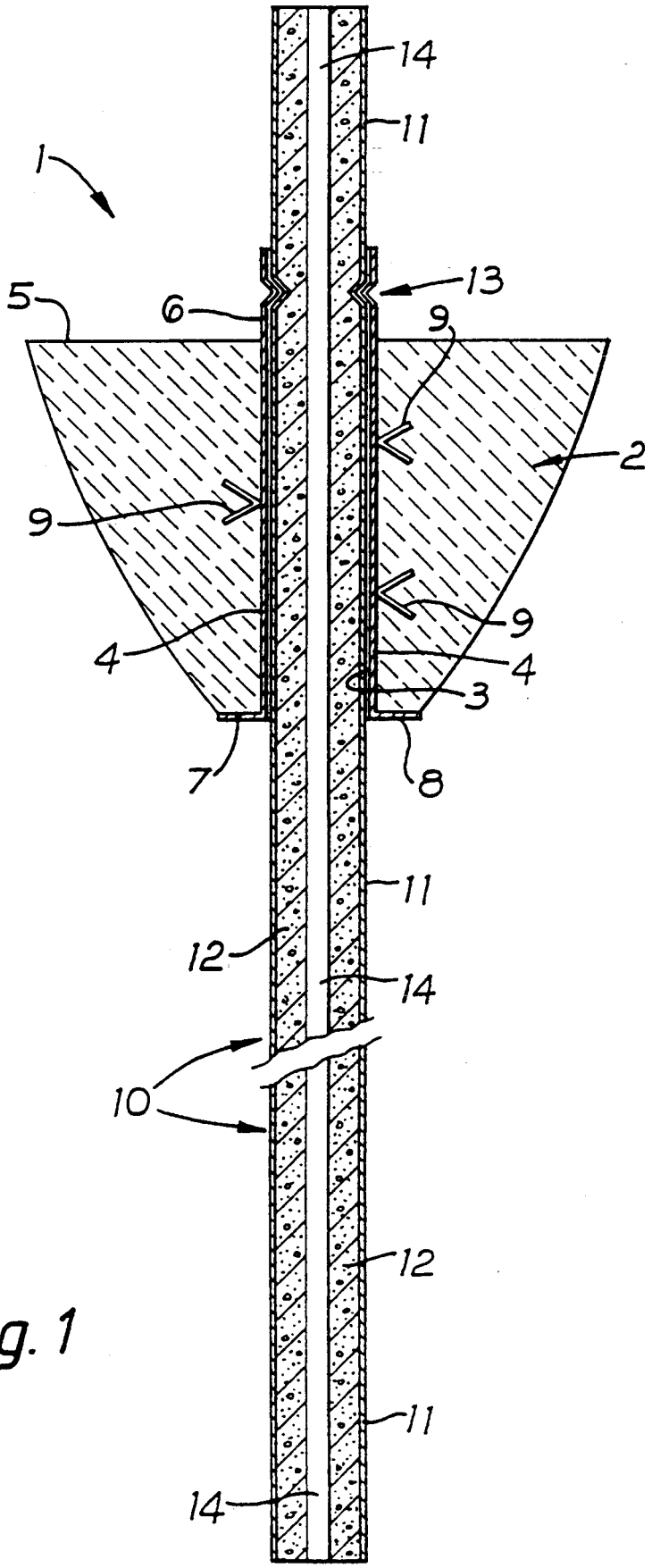
FIG. 1 is a longitudinal sectional view through a first embodiment of dart in accordance with the invention.
Figure 4:
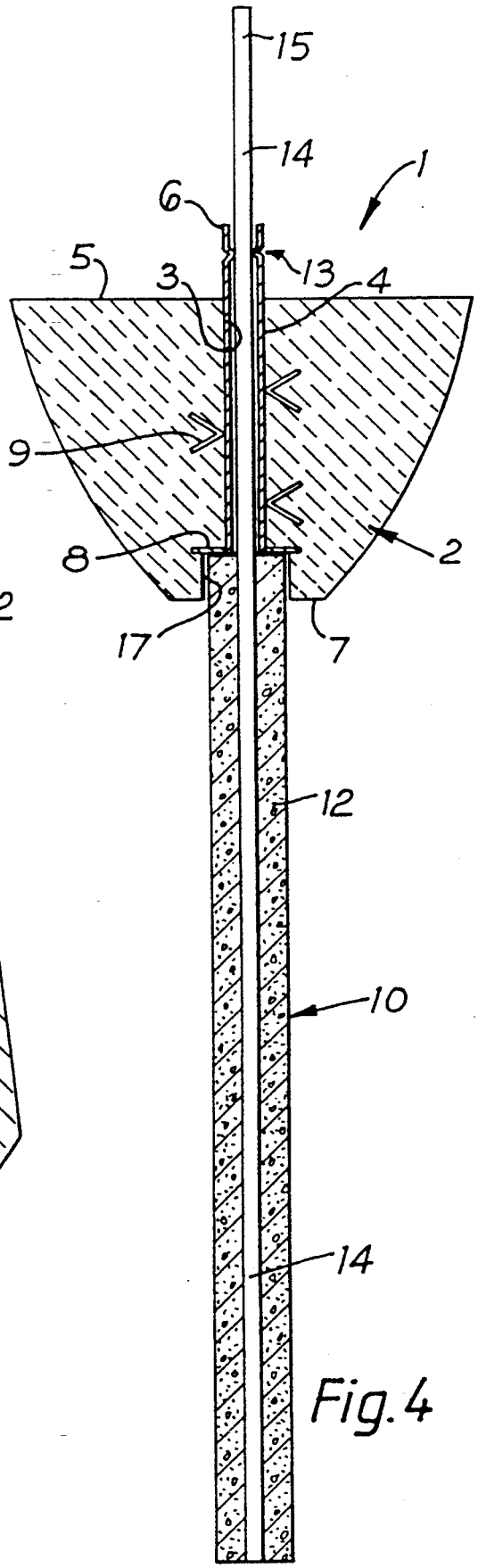

FIG. 4 corresponds to FIG. 1 but shows a fourth embodiment.

In both embodiments, like parts are accorded like reference numerals.

A metallurgical dart 1 comprises an enlarged refractory head 2 having a central through hole 3 lined with a mild steel sleeve 4. The head 2 has a top 5 above and beyond which a portion 6 of the sleeve 4 projects. The head 2 also has a bottom 7 while the sleeve 4 terminates with an integral, radially extending washer 8 engaging the bottom 7 of the head, and serving as a support shelf for the head. Keying of the refractory head 2 to its sleeve 4 is assisted by a plurality of 'V'-shaped anchorages 9 welded externally to the sleeve 4.

A tail 10 comprises an outer mild steel sleeve 11 filled with refractory concrete 12, the sleeve 11 either extending the full length of the tail 10 as illustrated in FIG. 1 or extending only part way along the length of the tail 10, with a monolithic refractory.

The sleeve 4 of the head 2 has an internal diameter D1, while the sleeve 11 of the tail 10 has an external diameter D2 slightly smaller than D1, such that the tail 10 can pass as a close sliding fit through the hole 3 of the head 2.

In accordance with the principal feature of the invention the head is secured to the tail by a crimped joint 13 between the tail sleeve 11 and the projecting portion 6 of the head sleeve 4, after the head 2 is fitted onto the tail 10 and slid along the tail 10 to the position where it is required to secure the head—which position may differ for different metallurgical applications.

Optionally, the tail 10 is provided with a central reinforcing bar 14 also of mild steel.

FIG. 3 illustrates the possibilty of forming, alternatively or in addition to the one crimped joint 13 illustrated in the embodiments of FIGS. 1 and 2, a crimped joint 13A below the bottom 7 of the head 2 by providing a portion 6A of the sleeve for projecting below the bottom 7, while the washer 8 is secured to the lining sleeve 3 by weld metal 16.

In the embodiment of FIG. 4, a socket 17 is formed in the bottom of the head 2 co-axial with the hole 3, with the washer 8 located at the upper, inner end of the socket 17, and with a terminal, upper end 18 of the refractory 12 of the tail 10 forming a shoulder to engage the underside of the washer. Furthermore, with this embodiment, the refractory 12 of the tail 10 does not pass through the hole 3, but stops at the washer 8, so that only the central reinforcing bar 14 passes through the hole 3 to form, with the portion 6 of the sleeve 4 above the top 5 of the head the crimped joint 13, with the reinforcing bar 14 extended beyond the joint 13 as a projection 15 engageable, by a gripper e.g. of a crane, for lifting the dart 1 and lowering the dart 1 into a metallurgical furnace, ladle etc., or possibly other furnace e.g. a glass making furnace.

I claim:

1. A metallurgical dart comprising an enlarged refractory head having a top, a bottom, an elongate tail extending from the bottom of the head and an engagement means projecting from the top of the head characterized in that the enlarged refractory head has a central through hole extending from top to bottom of the head and lined with a metallic sleeve, with a portion of a lining sleeve projecting beyond the top and/or bottom of the head, the elongate tail being of refractory material with an external and/or internal metallic element and having a cross-sectional shape corresponding to a cross sectional shape of the hole through the head, such that the tail can pass, as a close fit, through the lining sleeve of the head and there being at least one joint between at least one metallic element of the tail and said projecting portion of the lining sleeve, to fix the head and tail together.

2. A metallurgical dart as claimed in claim 1, characterized by an outer metallic sleeve encasing at least part of the refractory material.

3. A metallurgical dart as claimed in claim 1, characterized by a central reinforcing bar embedded within the refractory material of the tail and projecting from what, in use, is an upper end of the tail.

4. A metallurgical dart as claimed in claim 1, characterized in that the lining sleeve has a first projecting portion beyond an upper end of the head.

5. A metallurgical dart as claimed in claim 1, characterized in that the lining sleeve has a second projecting portion extending below a lower end of the head.

6. A metallurgical dart as claimed in claim 1, characterized in that the joint is formed in a projecting portion of the lining sleeve beyond an upper end of the head.

7. A metallurgical dart as claimed in claim 1, characterized in that the joint is formed in a projecting portion of the lining sleeve below a lower end of the head.

8. A metallurgical dart as claimed in claim 1, characterized in that the lining sleeve is provided with a radially extending washer adjacent a lower end thereof engaging the head and thus serving as a supporting shelf for the head.

9. A metallurgical dart as claimed in claim 3, characterized in that the reinforcing bar projects from the upper end of the tail and the joint is formed between a projecting portion of the reinforcing bar and a projecting portion of the liner sleeve.

10. A metallurgical dart as claimed in claim 9, characterized in that the reinforcing bar projects beyond the joint for engagement by a gripper for lifting and lowering the dart.

11. A metallurgical dart as claimed in claim 1, characterized in that a terminal upper end of the refractory material of the tail forms an engaging shoulder to abut the bottom of the head.

12. A metallurgical dart as claimed in claim 1, characterized in that a socket is formed in the bottom of the head, a washer of the lining sleeve is located at an inner end of the socket, and a terminal, upper end of the refractory material of the tail forms an engaging shoulder to abut an underside of the washer.

13. A method of assembling a metallurgical dart having an enlarged refractory head having a top, a bottom, an elongate tail extending from the bottom of the head and an engagement means projecting from the top of the head characterized in that the enlarged refractory head has a central through hole extending from top to bottom of the head and lined with a metallic sleeve, with a portion of a lining sleeve projecting beyond the top and/or bottom of the head, the elongate tail being of refractory material with an external and/or internal metallic element, and having a cross-sectional shape corresponding to that of the hole through the body, such that the tail can pass, as a close fit, through the lining sleeve of the head, said method comprising:

interengaging the tail and the hole of the head until such time as the head is located at the desired position along the tail, and forming a fixing joint between the lining sleeve and the metallic element of the tail.

* * * * *